US006263533B1

(12) United States Patent
Dimitry et al.

(10) Patent No.: US 6,263,533 B1
(45) Date of Patent: Jul. 24, 2001

(54) EXTRUDED FOAM REINFORCEMENT STRUCTURES FOR INNERSPRING ASSEMBLIES AND MATTRESSES

(75) Inventors: Said Dimitry, Greensboro; William Freeman, Highpoint, both of NC (US)

(73) Assignee: Sealy Technology LLC, Trinity, NC (US)

( * ) Notice: Subject to any disclaimer, the term of this patent is extended or adjusted under 35 U.S.C. 154(b) by 0 days.

(21) Appl. No.: 09/586,164

(22) Filed: Jun. 2, 2000

(51) Int. Cl.[7] ..... A47C 27/05
(52) U.S. Cl. ..... 5/717; 5/739; 5/740
(58) Field of Search ..... 5/716, 717, 718, 5/260, 261, 739, 740, 732; 267/96

(56) References Cited

U.S. PATENT DOCUMENTS 2,826,769 * 3/1958 Drews ..... 5/717
3,100,305 * 8/1963 Kaye ..... 5/732
3,618,146 * 11/1971 Ferdinand ..... 5/717
4,286,344 * 9/1981 Ikeda ..... 5/732
5,133,116 * 7/1992 Wagner et al. ..... 5/717
5,210,890 * 5/1993 Hagglund ..... 5/718
5,239,715 * 8/1993 Wagner ..... 5/717
5,787,532 * 8/1998 Langer et al. ..... 5/717

* cited by examiner

*Primary Examiner*—Michael F. Trettel
(74) *Attorney, Agent, or Firm*—Arter & Hadden LLP

(57) ABSTRACT

Extruded foam reinforcement pieces are described for assembly in connection with innerspring assemblies and mattresses. The pieces have optimized cross-sectional configurations which can be consistently extruded in continuous strands which are then cut to length according to the type and size of innerspring assembly. The pieces are configured to engage various components of the innerspring, including spring coils, spaces between spring coils, and framing borderwires. The foam reinforcement pieces facilitate attachment and alignment of overlying material such as padding and upholstery and function to improve the support characteristics of an innerspring. Various embodiments of extruded foam reinforcement pieces include a support element configured to attach about the exterior of a single coil at a corner of an innerspring; a relatively short span side wall support which engages vertically between coils adjacent a vertical side wall of the innerspring; and a tapered edge structure configured to fit over side edges of an innerspring, with padding and upholstery attachable over each of the various foam reinforcement structures to improve the form and strength of an innerspring assembly.

17 Claims, 5 Drawing Sheets

EXTRUDED FOAM REINFORCEMENT STRUCTURES FOR INNERSPRING ASSEMBLIES AND MATTRESSES

FIELD OF THE INVENTION

The present invention pertains generally to flexible support structures such as seating and bedding and, more particularly, to internal flexible structures for use in mattresses and furniture.

BACKGROUND OF THE INVENTION

Innerspring assemblies for mattresses or seating structures such as sofas are generally composed of a plurality of spring coils tied together in a matrix or array. In a mattress innerspring, border wires usually encircle both the upper and lower perimeters of support surfaces formed by the ends of the vertically oriented coils. The border wires are connected to convolutions of the perimetrical springs by hog rings. The border wires are attached to top and bottom convolutions of the perimeter coils. Alternatively, the coils may have offset sections located near the ends which extend radially beyond the terminal convolutions, and wherein the terminal convolutions extend axially beyond the offset sections, as described for example in Sealy U.S. Pat. No. 5,713,088. It is a common practice to overlap the terminal convolutions of adjacent spring coils in a row, and then wind even smaller diameter helical spring coils, referred to as cross-helicals, across the rows to encircle the overlapped terminal convolution portions. Such an innerspring construction is described for example in Sealy U.S. Pat. No. 4,726,572. Other types of innersprings may have spring and support elements made or plastic or composite materials.

With respect to the perimeter of the innerspring assemblies of mattresses, there are some general considerations of construction and manufacture. In the normal use of a mattress, the edges of the innerspring are subjected to greater compression forces than the interior of the innerspring, largely due to the common practice of sitting on the edge of the bed. The added stresses and strains on the edges of the innerspring are evident in a general rounding of the mattress at the perimeter, creating a condition known as "roll-off". This is especially true of the edges and corners of a mattress which are the weakest structural points of the mattress, particularly in lower end mattress designs in which the innerspring assemblies rely entirely on the weight bearing ability of the coils for the mattress to maintain its shape. The innerspring can further give the impression of a degree of softness it does not have, since a person sitting on the edge provides a much more concentrated load on the underlying springs than a prone body upon a central portion of the innerspring.

Different types of reinforcements have been used in connection with innerspring assemblies to overcome these weaknesses. For example, Sealy U.S. Pat. No. 5,787,532 describes various foam structures interlockingly engaged with mattress innersprings to improve the shape and support characteristics. Some of the foam shapes described, though highly functional, are rather complex and therefore somewhat difficult to manufacture and assemble. Extrusion of foam pieces of different cross-sectional configurations has been proven to be efficient, so long as the shape is not overly complex. Also, dimensional tolerance is sometimes difficult to achieve given the somewhat unpredictable expansion behavior of different types of foam as it exits the extrusion die. Therefore, foam pieces of relatively simple cross-sectional configuration are preferable for consistency. Also, smaller and more compact foam pieces are easier to engage with innerspring assemblies. Large or long structures have a tendency to disengage before the padding and upholstery is attached over the foam to secure it in place. The assembly of mattresses is largely a manual process. In particular, the installation of padding and upholstery to the top and bottom surfaces of the innerspring and about the borderwire is very difficult. Much dimensional variation can occur in the process, due to deflection of the springs and compression of the padding material, resulting in uneven seam lines. Adding structural elements to the innerspring.

SUMMARY OF THE PRESENT INVENTION

In view of the difficulties and drawbacks encountered with previous innerspring; reinforcement structures, there is a need for various types of modular innerspring reinforcements which provide rigidity and shape-retention of the innerspring. There is also a need for relatively simple mattress reinforcement structures which are easy to manufacture to consistent tolerances, and easy to install in a manual assembly process.

The present invention provides four different types of extruded foam innerspring reinforcement structures of relatively simple geometry, which are easy to manufacture and install or engage with an innerspring. The four types of innerspring reinforcement structures include: 1) a corner coil reinforcement member; 2) a side wall reinforcement member having a planar wall section, 3) a single piece side wall reinforcement, and 4) a tapered edge reinforcement member.

In one aspect of the invention, there is provided an extruded foam corner coil reinforcement configured to fit axially about an outer diameter of each of the corner coils of an innerspring unit, and between upper and lower border wires. The corner coil reinforcement structure substantially strengthens the innerspring at the corners and improves the dimensional stability and appearance of the overlying padding and upholstery.

In another aspect of the invention, there is provided an extruded foam reinforcement structure configured for engagement with coils of the innerspring to substantially strengthen the sides of the innerspring. One or more vertically disposed vertical members are engaged between the turns of adjacent coils at the perimeter of the innerspring. A planar wall portion is attached to the vertical members to closely abut the perimetric coils and provide a smooth substantially rigid side wall to the innerspring over which padding and upholstery is attached.

And in another aspect of the invention, there is provided a tapered anti-roll-off extruded foam structure adapted to fit at an edge of a supporting surface of an innerspring. The structure provides a surface edge which is tapered inward from the edge toward the center of the innerspring support surface, and a registration lip which fits over a borderwire or top edge of the perimetric coils of the innerspring, to accurately position the edge structure. The edge structure counters the roll-off effect of innersprings.

The invention further includes innerspring assemblies in combination with all or combinations of some of the four disclosed reinforcement structures.

These and other novel aspects of the invention are herein described in particularized detail with reference to the accompanying Figures. While shown in certain preferred and alternate embodiments, it will be appreciated that the basic concepts and forms of the invention could be implemented in other equivalent ways which are nonetheless within the scope of the invention as defined by the accompanying claims and equivalents thereof.

DETAILED DESCRIPTION OF THE INVENTION

Figure 1:
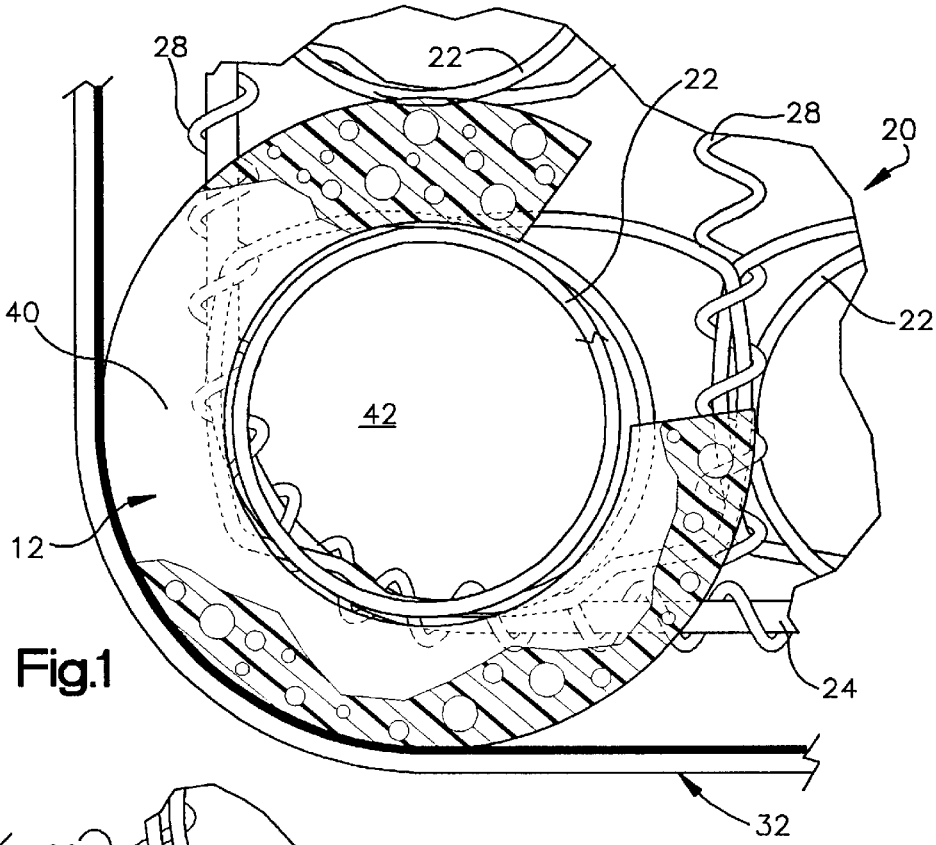
FIG. 1 is a top view showing a surface of a mattress including an innerspring corner reinforcement according to the present invention.
Figure 3:
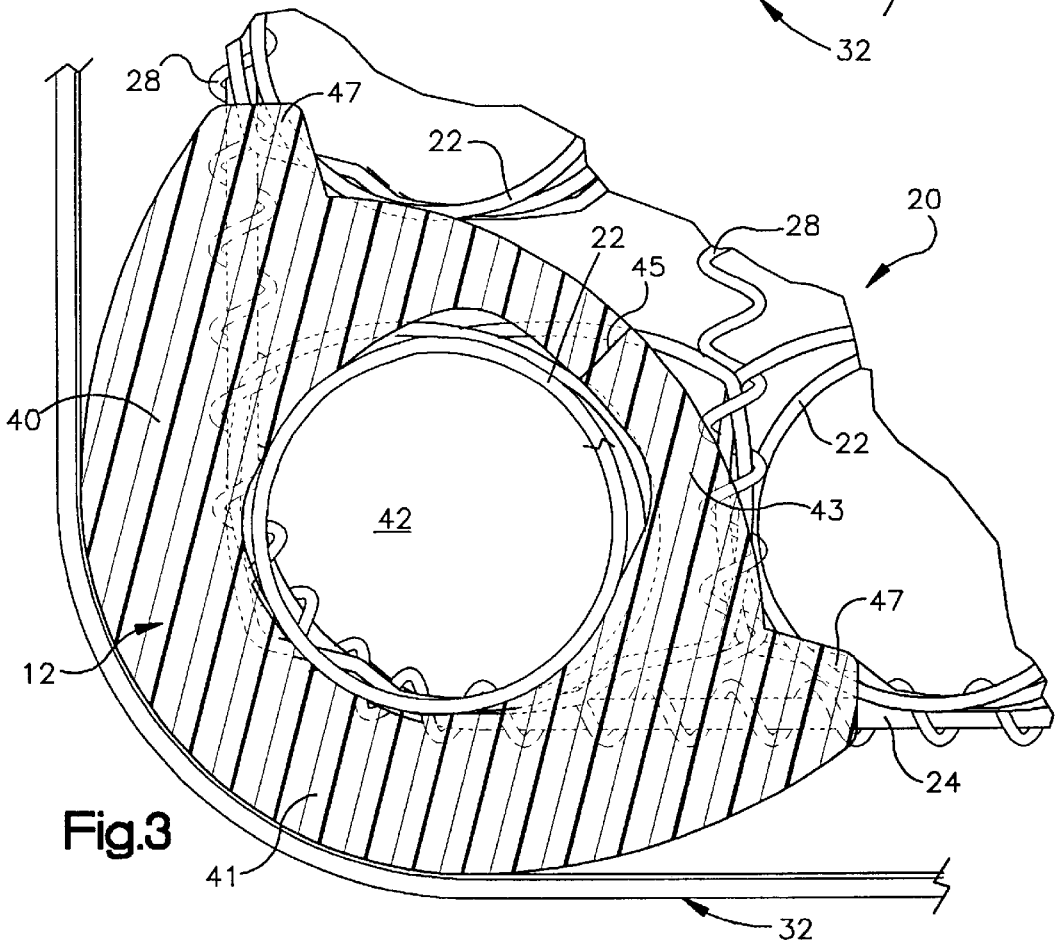
FIG. 3 is a top sectional view of the mattress including the innerspring corner reinforcement of FIG. 1.
Figure 2:
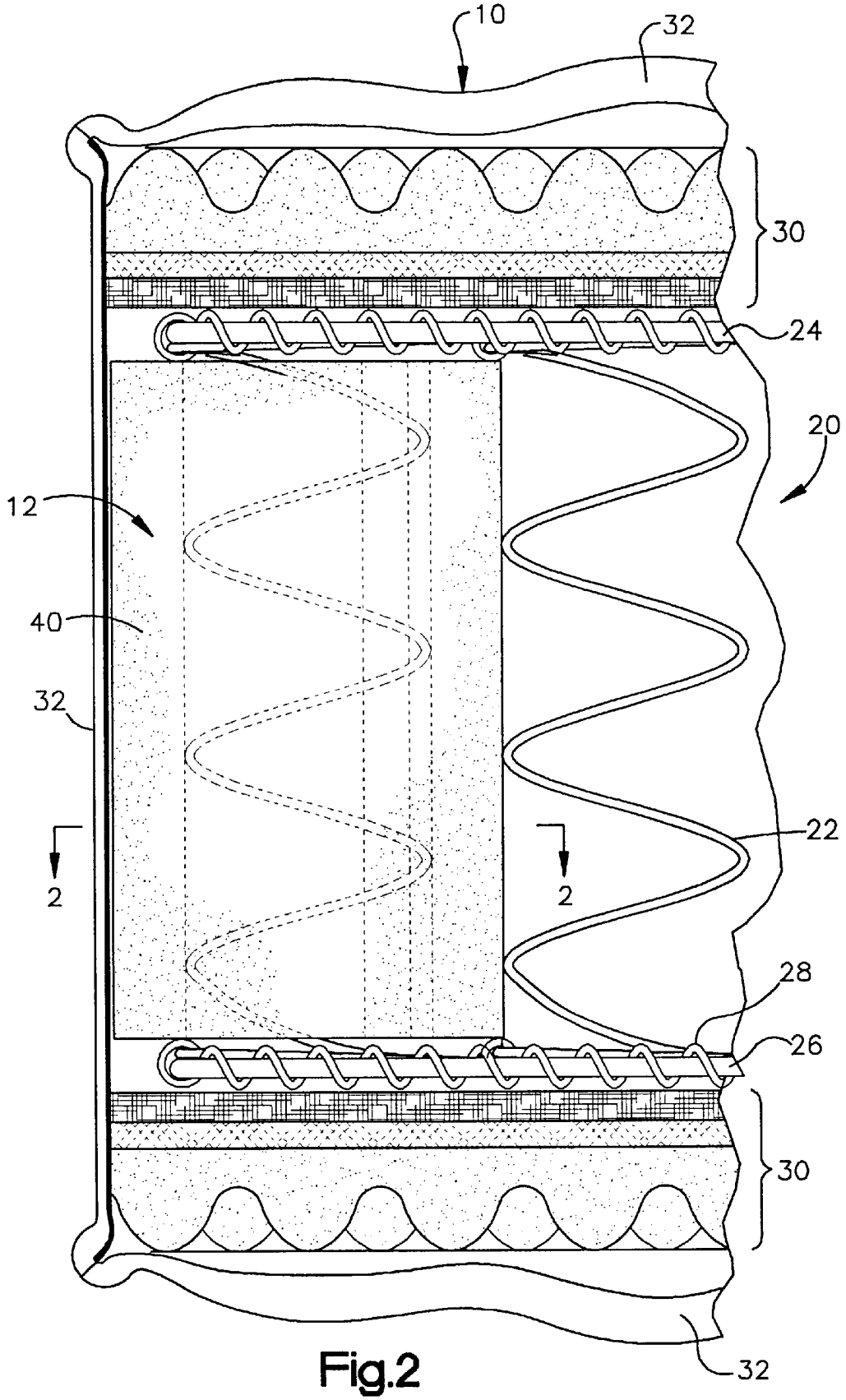
FIG. 2 is side sectional view depicting the arrangement of the mattress including the innerspring corner reinforcement of FIG. 1.

FIGS. 1–3 illustrate one aspect or embodiment of the invention in the form of an extruded structural foam innerspring corner coil reinforcement member 12 for use with an innerspring assembly or "innerspring" 20 such as the interconnected matrix of steel wire coils in a typical mattress, indicated generally at 10. In the mattress innerspring 20, a plurality of coils 22 are arranged in an interconnected matrix to form a flexible core structure and support surfaces of the mattress 10. Upper and lower border wires 24, 26 are attached to the upper and lower end turns of the coils 22 at the perimeter of the array to create a frame about the upper and lower edges of the innerspring. The coils 22 are connected to the border wires 24, 26 and each other through interconnection helical wires 28. Upholstery 32 covers the entire innerspring, the structural reinforcement members, and all of the padding and materials on the innerspring. A substantial amount of padding 30 covers the major flat sides of the innerspring. It may be in layers and include cotton batting, slab or convoluted foam or other types of resilient, absorbent or fire or moisture resistant textiles or materials.

The innerspring corner coil reinforcement member 12 functions as a structural reinforcement and support member. It has a flexible body portion 40 formed of an extruded polymer foam such as polyurethane, polyethylene, or other types of polymers suitable for use in foam product formation processes such as extrusion. In a particular embodiment, the flexible body portion is substantially cylindrical and has a hollow central region 42 for receiving the corner coil 22. The flexible body portion 40 extends between the upper and lower border wires 24, 26 and is held securely in this position by axial compression between the border wires, and by radial compression about the body of the corner coil 22, or in other words by frictional contact with the outer diameter of the helical turns of the coil 22. In a preferred embodiment, the flexible body portion surrounds at least 80% of the corner coil 22, but any extent that would provide the desired support and sufficient frictional attachment about the external diameter of the coil could be used and is within the scope of the invention.

The innerspring corner coil reinforcement member 12 is particularly advantageous in the process of mattress construction, by providing a substantially rigid corner structure about which the described padding and upholstery is placed and secured by sewing. Compression of the innerspring at the border wire edges, and particularly at the corners, is problematic for the assembler trying to achieve uniformity in the nominal thickness of the mattress padding, and straight sewn seam lines. By making the corners of the innerspring substantially rigid, the corner coil reinforcement member 12 creates a stiff framework about which the upholstery can be stretched tight, compressing the padding and creating a neat finished appearance to the mattress.

The corner member 12 is preferably manufactured by a continuous extrusion process of foam forming material forced through an extrusion die cut to a shape which corresponds to the desired shape of the product when the foam is fully foamed. The extruded shape is then cut to the desired length, e.g., to the length of the corner coil 22 or the total vertical extent between the upper and lower border wires. During assembly of the mattress, the precut corner member 12 is attached about the corner coil 22 as described above so that it fits securely between the upper and lower border wires 24, 26. In this way, the corner member 12 provides stability to the corner in the vertical direction, thereby providing a gauge to the assembler to insure that a proper amount of padding is secured to the innerspring 20, a proper amount of padding is secured to the innerspring 20, and that the proper tension is placed on the upholstery material during securement. In this way, the present corner member provides a precise method of producing a mattress with a consistent padding content, upholstery tension and fit, and uniform appearance.

FIG. 3 illustrates the cross-section of an especially preferred embodiment of the corner coil reinforcement member 12 wherein the body portion 40 includes an arcuate exterior wall 41 and an arcuate interior wall 43. The radius of curvature of the exterior wall 41 is approximately equal to that of a bend in the border wire 24 at the innerspring corner, and defines the radius of the exterior upholstery 32. The radius of curvature of the interior wall 43 is slightly larger than that of the exterior wall 41, and is slightly recessed within exterior wall 41, behind extensions 47 of the exterior wall. The extensions 47 further promote engagement of the structure 12 with the innerspring. A split 45 in interior wall 43 allows the structure 12 to be installed about the circumference of corner coil 22. The opposing legs of interior wall 43, on either side of split 45, are slightly tapered and dimensioned to fit between the corner coil and the two coils adjacent to the corner coil.

Figure 4:
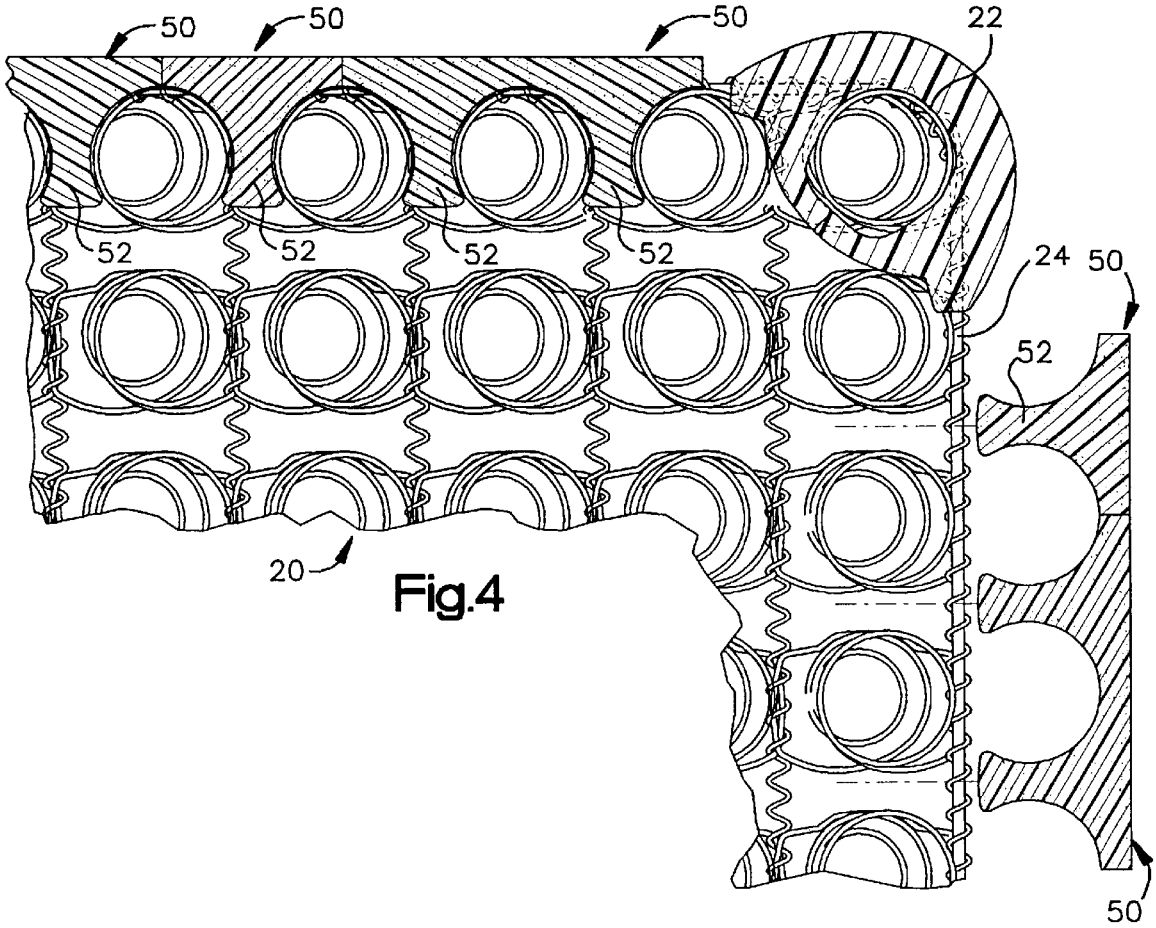
FIG. 4 is a partial top view of an innerspring in combination with innerspring side wall support components of the present invention.

As shown in FIG. 4, the invention further includes compact extruded foam side wall reinforcement structures, indicated generally at 50, configured for engagement with the lateral edges of an innerspring 20. The foam side wall structures 50 include a planar wall portion 54 and one or two vertical members 52 which are configured to fit between the helical turns of adjacent coils on the perimeter or side of the innerspring 20. In practice, the vertical members 52 are integrally formed with the flat planar wall portion 51, and the intersection of these elements is curved to form partial cylindrical cavities in which the coil bodies fit. The planar wall portion 54 preferably has a height approximately equal to a thickness dimension of the innerspring as measured from the upper to lower border wires 24, and a length dimension at least equal to the lateral spacing of the vertical members 52, and preferably slightly longer. The vertical members 52 are selectively spaced to fit between immediately adjacent coils as shown in FIG. 4, or alternately two or more coils apart so that the planar member 54 spans several adjacent coils of the innerspring side. Although several wall structures 50 are thus needed to traverse an entire side of the innerspring, this is actually preferable to a long, continuous structure which cannot be efficiently or economically extruded through a foam extrusion die process. For example, a continuous innerspring side wall reinforcement piece may have ten or twenty or more, vertical elements to interlock between the coils. This presents an unwieldy piece geometry to produce by an extrusion process, and requires a very complex and expensive extrusion die, with multiple cavities for the vertical coil-engaging members which extend from the planar side wall. Also, side wall parts made to run the length of an innerspring are awkward to ship and inventory. Separate parts are required for the innerspring end walls, adding to the shipping and inventory burden. By dividing the side wall reinforcement structure up into relatively short segments which engage between only one, two or several coils as in the present invention, a universal part 50 is provided which is economical to manufacture, easy to assembly, and can be used on the length or width side walls of an innerspring.

Figure 7A:
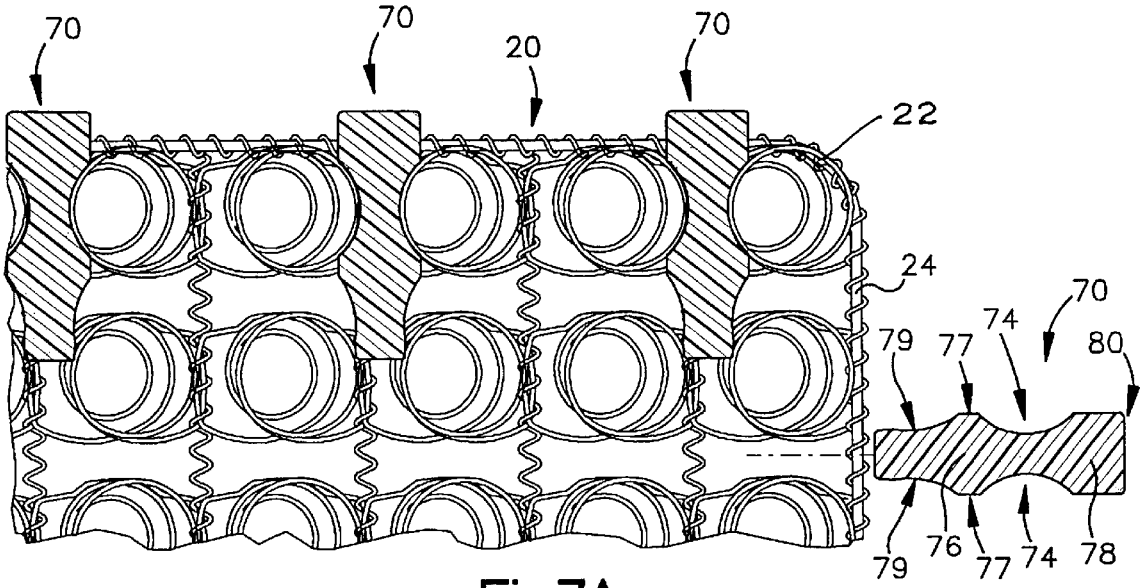
FIGS. 7A and 7B are views of an alternate embodiment of an innerspring side wall extruded support structure of the invention.
Figure 7B:
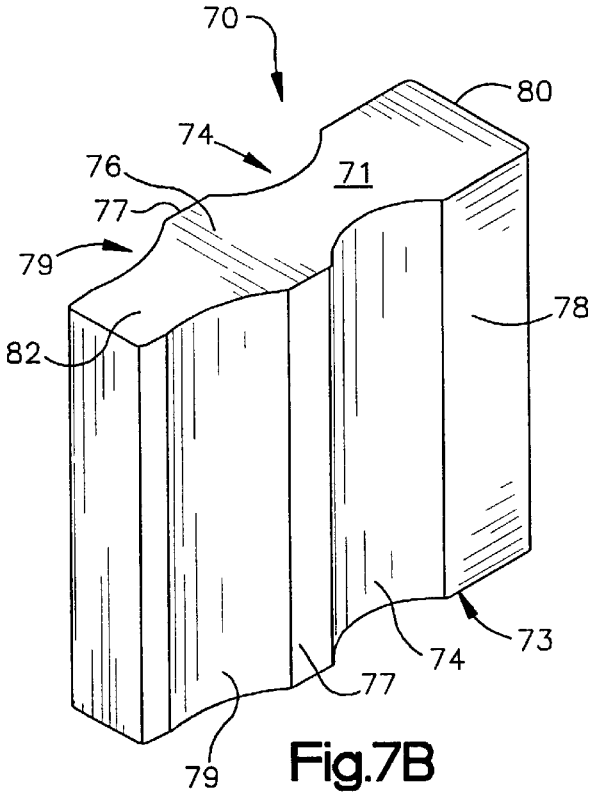

FIGS. 7A and 7B illustrate an alternate embodiment of extruded foam innerspring side wall reinforcement structures, indicated generally at 70. Each piece 70 is configured with a contoured body portion 72 having a first set of opposed and radiused detents 74 dimensioned to fit securely between the outer circumference of two adjacent coils 22. The first set of detents 74 terminate at an inboard end at a midsection 76 which, once forced between and past the radii of the opposing coils 22, secures the piece 70 in position therebetween. The piece is further secured at an outboard end by head 78 which has a generally planar surface 80 to define an outermost vertical plane to the innerspring side wall, over which padding and upholstery will be applied. The linear spacing between the head 78 and midsection 76 is designed according to the outer diameter of the turns of the coils 22. The midsection 76 has generally planar vertically oriented side walls 77 which are positioned between the outer and next interior rows of coils. By this design, the piece 70 is securely engaged between the coils. An extension section 82, having a second set of radiused detents 79, extends inboard beyond midsection 76, to reach the next inboard row of coils, and to extend at least partially between the next row of coils. This section 82 further engages the piece 70 with the innerspring assembly, making it more stable and integrated with the dynamics of the innerspring under various loads. The vertical extent of the piece 70 is defined by upper and lower ends 71 and 73, dimensioned to fit between the respective upper and lower border wires 24, which further engage the piece 70 by compression. Although illustrated between every other coil, any number and spacing of pieces 70 between the coils can be made to reinforce the innerspring 20 near the perimeter.

Figure 5:
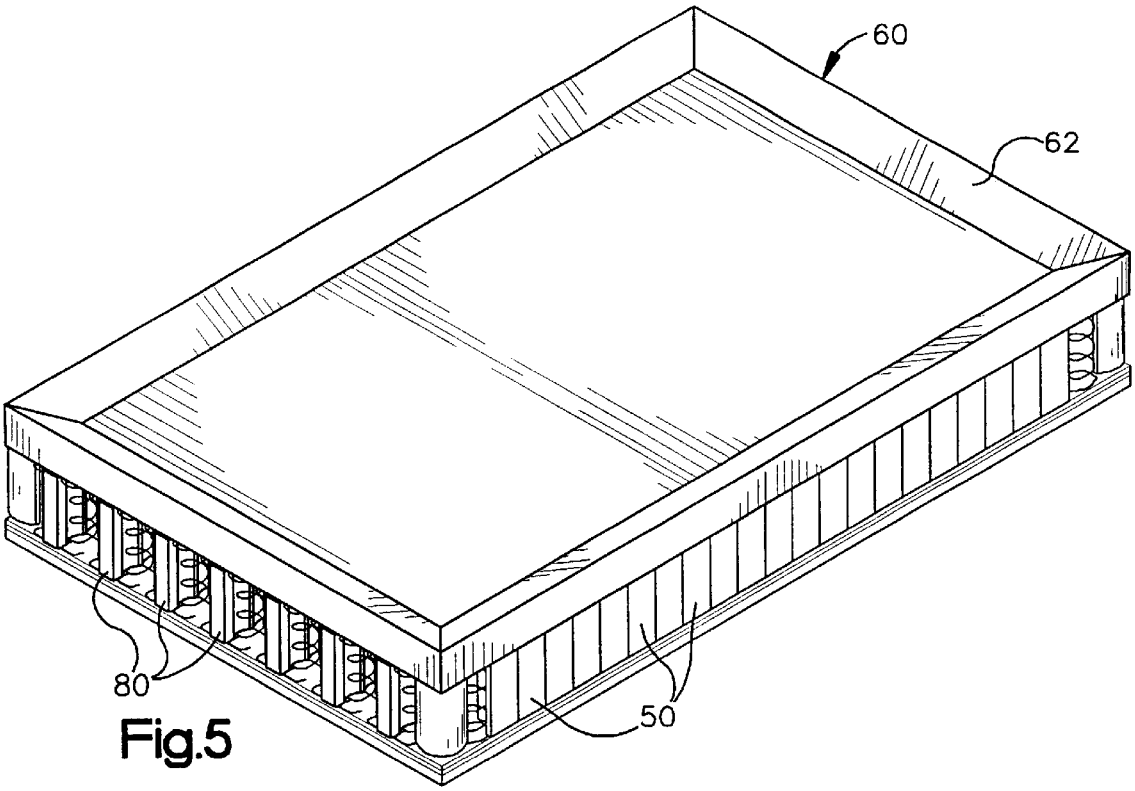
FIG. 5 is a perspective view of a tapered innerspring edge structure of the present invention.
Figure 6:
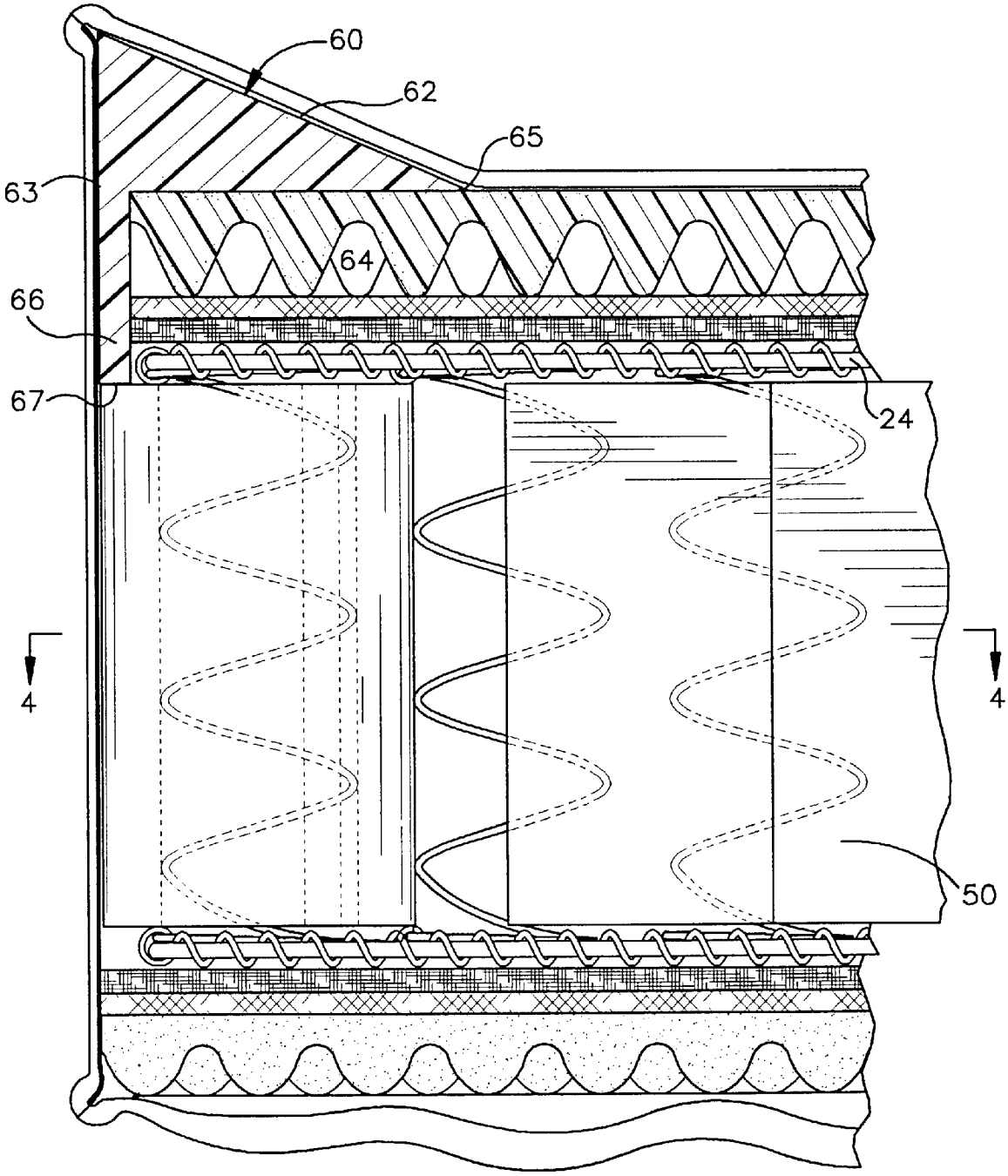
FIG. 6 is an elevation of a corner and edge portion of an innerspring including an innerspring corner reinforcement and a tapered edge structure of the present invention.

FIGS. 5 and 6 illustrate another type of extruded foam reinforcement structure for use in connection with the edges of the planar supporting surfaces of an innerspring assembly. An anti-roll-off tapered edge piece 60 is a continuous extruded foam piece which has a tapered top surface 62 angled inward from a vertical wall 63 positioned approximately over the innerspring edge at borderwire 24. A mounting surface 64 extends from the innerspring edge (defined by borderwire 24) toward the center of the innerspring, joining the tapered top surface 62 at essentially the top supporting surface of the innerspring 20 and inboard of the borderwire-defined edge by, e.g. several inches. This point of intersection is identified as the "inboard apex" 65. Extending downward at substantially a right angle from surface 64 is a flange 66 configured to closely abut the lateral edge of the innerspring 20 and borderwire 24. The flange or lip 66 facilitates accurate positioning and registration of the tapered edge piece 60 along the surface perimeter of the innerspring 20, before, during and after installation of padding and upholstery. The lip 66 has a distal end 67 which faces and may be in contact with an edge of the planar wall portion of a side wall reinforcement structure 50, to form a continuous rigid foam structure along the side of the innerspring and over the edge on which tapered edge piece 60 fits. The anti-roll-off tapered edge piece 60 functions to counteract the tendency of innerspring edges to compress to a greater extent than other areas. The tapered edge piece 60 also provides a semi-rigid edge guide by which the fit and finish of the outer upholstery is improved. Also, the tapered edge piece 60 creates in essence a well on the surrounded support surface of the innerspring which is filled by padding material, for example equal in height to the rise of the tapered edge. This allows installation of a substantial amount of padding without creating excessively rounded edges, which require greater tension on the covering upholstery and contributes to the roll-off effect.

The relatively simple cross-sectional configuration of the tapered edge piece 60 is highly suitable for production by a continuous foam extrusion processes, from which appropriate lengths are cut to extend along each of the side edges of an innerspring. The described extruded foam reinforcement pieces can be advantageously used in combination in connection with a common innerspring, and in combination with other types of foam structures. For example, foam pieces fit internal to the innerspring, such as described in U.S. Pat. No. 5,133,116, may be used in conjunction with the corner coil reinforcement 12, side wall support structures 50, and tapered edge 60. As mentioned, the discrete foam pieces are easily manufactured by continuous extrusion, cut to design lengths, and easily assembled with the innerspring, The modular nature of the pieces, and the lack of any separate fasteners, enables flexible and customized production of a wider variety of mattress models having differing support characteristics.

As described hereinabove, the present invention solves many problems associated with previous type apparatuses. However it will be appreciated that various changes in the details, materials and arrangements of parts which have been herein described and illustrated in order to explain the nature of the invention may be made by those skilled in the art within the principle and scope of the invention will be expressed in the appended claims.

What is claimed is:

1. An innerspring having a plurality of interconnected coils in a generally rectangular array and upper and lower border wires located at top and bottom ends of coils of the array about a perimeter of the innerspring, a corner coil reinforcement member positioned about each corner coil of the rectangular array of the innerspring, the corner coil reinforcement member having a generally cylindrical body portion dimensioned to extend from an upper border wire to a lower border wire, and having a cylindrical internal cavity configured to fit substantially entirely about an outer circumference of the coil, an exterior wall having an external surface configured to be generally aligned with a bend in the upper and lower border wire at the corners of the innerspring, and an interior wall configured to fit between a corner coil and at least two coils adjacent to a corner coil, the exterior wall having a radius of curvature different than a radius of curvature of the interior wall, and the exterior wall having a thickness greater than a thickness of the interior wall.

2. An innerspring side wall reinforcement member for use in combination with an innerspring assembly having a plurality of interconnected coils in a generally rectangular array and upper and lower border wires located at top and bottom ends of coils of the array about a perimeter of the innerspring, each of the coils having a generally helical configuration with top ends of the coils in a common plane and bottom ends of the coils in a common plane, the side wall reinforcement member having a planar wall portion having a height dimension approximately equal to a distance from an upper border wire to a lower border wire, and a length dimension sufficient to span at least two adjacent coils of the innerspring and being substantially less than a length of a side wall portion of the innerspring, two laterally spaced-apart vertical members attached to one side of the planar wall portion and extending substantially the entire height of the planar wall portion, each of the vertical members configured to fit between adjacent coils of the innerspring to position the planar wall portion against at least two perimeter coils of the innerspring.

3. The side wall reinforcement member and innerspring combination of claim 2 wherein there are at least three or more side wall reinforcement members on each side of the innerspring.

4. The side wall reinforcement member and innerspring combination of claim 2 wherein the vertical members of the side wall reinforcement member are laterally spaced apart a distance sufficient to span two coils between the vertical members.

5. The side wall reinforcement member and innerspring combination of claim 2 wherein the vertical members are laterally spaced apart a distance sufficient to span three coils between the vertical members.

6. The side wall reinforcement member and innerspring combination of claim 2 wherein ends of the planar portions of adjacent reinforcement members are abutting along a side wall of the innerspring.

7. The side wall reinforcement member and innerspring combination of claim 2 wherein ends of the planar portions of adjacent reinforcement members are spaced apart along a side wall of the innerspring.

8. An innerspring edge formation structure configured to be positioned along perimeter edges of a mattress innerspring, the edge formation structure having a tapered cross-sectional configuration with a vertical wall generally alignable with an edge of an innerspring, an inboard apex generally opposed to the vertical wall, a mounting surface configured to contact a perimeter surface of the innerspring, and a lip which extends generally orthogonally from the mounting surface over a portion of an adjacent side wall of the innerspring, whereby positioning of an edge of the innerspring at an intersection of the lip and the mounting surface locates the edge formation structure to provide a tapered support surface from an outboard edge of an innerspring toward a center of the innerspring.

9. The innerspring edge formation structure of claim 8 in combination with an innerspring wherein the mattress edge formation structure extends about substantially an entire perimeter of the innerspring.

10. The innerspring edge formation structure of claim 8 in combination with an innerspring wherein the edge formation structure is in substantially direct contact with the innerspring.

11. The innerspring edge formation structure of claim 8 in combination with an innerspring wherein the edge formation structure is in direct contact with one or more layers of material in substantially direct contact with the innerspring.

12. The innerspring edge formation structure of claim 8 in combination with an innerspring wherein the edge formation structure is in direct contact with at least one foam layer which is supported by the innerspring.

13. The mattress edge formation structure of claim 8 in combination with an innerspring, and in combination with one or more innerspring side wall reinforcement structures having a planar wall portion positioned closely adjacent perimeter coils of the innerspring, and wherein a distal end of the lip of the mattress edge formation structure is facing an edge of the planar wall portion of the side wall reinforcement structure.

14. The combination of claim 13 further including an innerspring corner coil reinforcement structure, and wherein the side wall reinforcement structures do not extend to corners of the innerspring.

15. A structurally reinforced innerspring assembly having a plurality of coils interconnected in a rectangular array, and three different reinforcement structures attached to the innerspring, the innerspring having a plurality of interconnected coils in a generally rectangular array and upper and lower border wires located at top and bottom ends of coils of the array about a perimeter of the innerspring, each of the coils having a generally helical configuration with top ends of the coils in a common plane and bottom ends of the coils in a common plane, a corner coil reinforcement member attached to one coil at each of four corners of the rectangular array, the corner coil reinforcement member having a generally cylindrical body portion dimensioned to extend from an upper border wire to a lower border wire, and having a cylindrical internal cavity configured to fit substantially entirely about an outer circumference of the coil, an exterior wall having an external surface configured to be generally aligned with a bend in the upper and lower border wire at the corners of the innerspring, and an interior wall configured to fit between a corner coil and at least two adjacent coils, the exterior wall having a radius of curvature different than a radius of curvature of the interior wall, and the exterior wall having a thickness greater than a thickness of the interior wall, a side wall reinforcement member having a planar wall portion with a length dimension sufficient to span at least two adjacent coils of the innerspring and being substantially less than a length of a side wall portion of the innerspring, and a height dimension approximately equal to a distance from an upper border wire to a lower border wire of the innerspring, two laterally spaced-apart vertical members attached to one side of the planar wall portion and extending substantially the entire height of the planar wall portion, each of the vertical members configured to fit between adjacent coils of the innerspring to position the planar wall portion against at least two perimeter coils of the innerspring, and an innerspring edge formation structure configured to be positioned along perimeter edges of a mattress innerspring, the edge formation structure having a tapered cross-sectional configuration with a vertical wall generally alignable with an edge of an innerspring, an inboard apex generally opposed to the vertical wall and a tapered support surface extending between a top of the vertical wall and the inboard apex, a mounting surface configured to contact a perimeter surface of the innerspring, and a lip which extends generally orthogonally from the mounting surface over a portion of an adjacent side wall of the innerspring, whereby positioning of an edge of the innerspring at an intersection of the lip and the mounting surface locates the edge formation structure and the tapered support surface to extend from an outboard edge of an innerspring toward a center of the innerspring.

16. An innerspring side wall reinforcement piece configured to be inserted between adjacent coils at a perimeter of an innerspring, the side wall reinforcement piece comprising a body having a first set of laterally opposed generally radiused detents configured to fit between turns of adjacent coils at the perimeter of an innerspring, a head section connected to the body at a point outboard of the coils at the perimeter of the innerspring when the piece is engaged with the coils, a second set of laterally opposed generally radiused detents in the body at a point positioned inboard of the first set of detents when the piece is engaged with an innerspring, the second set of detents configured to fit between adjacent coils located in a row next to coils at a perimeter of an innerspring, the piece having a vertical extent approximately equal to a width of an innerspring with which it is engaged.

17. An innerspring in combination with foam reinforcement structures, the innerspring having a plurality of interconnected coils in a generally rectangular array and upper and lower border wires located at top and bottom ends of coils of the array about a perimeter of the innerspring, each of the coils having a generally helical configuration with top ends of the coils in a common plane and bottom ends of the coils in a common plane, the foam reinforcement structures including:

1) a corner coil reinforcement member attached to one coil at each of four corners of the rectangular array of coils, the corner coil reinforcement member having a generally cylindrical body portion dimensioned to extend from an upper border wire to a lower border wire, and having a cylindrical internal cavity configured to fit substantially entirely about an outer circumference of the coil, an exterior wall having an external surface configured to be generally aligned with a bend in the upper and lower border wire at the corners of the innerspring, and an interior wall configured to fit between a corner coil and at least two adjacent coils, the exterior wall having a radius of curvature different than a radius of curvature of the interior wall, and the exterior wall having a thickness greater than a thickness of the interior wall, 2) a side wall reinforcement member having a planar wall portion with a length dimension sufficient to span at least two adjacent coils of the innerspring and being substantially less than a length of a side wall portion of the innerspring, and a height dimension approximately equal to a distance from an upper border wire to a lower border wire of the innerspring, two laterally spaced-apart vertical members attached to one side of the planar wall portion and extending substantially the entire height of the planar wall portion, each of the vertical members configured to fit between adjacent coils of the innerspring to position the planar wall portion against at least two perimeter coils of the innerspring, 3) an innerspring side wall reinforcement piece configured to be inserted between adjacent coils at a perimeter of an innerspring, the side wall reinforcement piece comprising a body having a first set of laterally opposed generally radiused detents configured to fit between turns of adjacent coils at the perimeter of an innerspring, a head section connected to the body at a point outboard of the coils at the perimeter of the innerspring when the piece is engaged with the coils, a second set of laterally opposed generally radiused detents in the body at a point positioned inboard of the first set of detents when the piece is engaged with an innerspring, the second set of detents configured to fit between adjacent coils located in a row next to coils at a perimeter of an innerspring, the piece having a vertical extent approximately equal to a width of an innerspring with which it is engaged, and 4) an innerspring edge formation structure configured to be positioned along perimeter edges of a mattress innerspring, the edge formation structure having a tapered cross-sectional configuration with a vertical wall generally alignable with an edge of an innerspring, an inboard apex generally opposed to the vertical wall and a tapered support surface extending between a top of the vertical wall and the inboard apex, a mounting surface configured to contact a perimeter surface of the innerspring, and a lip which extends generally orthogonally from the mounting surface over a portion of an adjacent side wall of the innerspring, whereby positioning of an edge of the innerspring at an intersection of the lip and the mounting surface locates the edge formation structure and the tapered support surface to extend from an outboard edge of an innerspring toward a center of the innerspring.

* * * * *